US009120243B2

(12) United States Patent
Tutschek et al.

(10) Patent No.: US 9,120,243 B2
(45) Date of Patent: Sep. 1, 2015

(54) TOOL INSERT

(75) Inventors: Alex Tutschek, Edmonton (CA); Mihai Corabian, Edmonton (CA); Dragan Bogojevic, Edmonton (CA)

(73) Assignee: Boundary Equipment Co. Ltd., Edmonton (CA)

( * ) Notice: Subject to any disclaimer, the term of this patent is extended or adjusted under 35 U.S.C. 154(b) by 0 days.

(21) Appl. No.: 13/559,422

(22) Filed: Jul. 26, 2012

(65) Prior Publication Data

US 2013/0026811 A1 Jan. 31, 2013

(30) Foreign Application Priority Data

Jul. 28, 2011 (GB) ..... 1112967.3

(51) Int. Cl.

| | |
|---|---|
| ***E21C 35/183*** | (2006.01) |
| ***B28D 1/18*** | (2006.01) |
| *E21C 35/18* | (2006.01) |

(52) U.S. Cl.

CPC ..... *B28D 1/188* (2013.01); *E21C 35/183* (2013.01); *E21C 2035/1806* (2013.01); *E21C 2035/1816* (2013.01)

(58) Field of Classification Search

CPC ..... E21C 35/183; E21C 2035/1816; E21C 2035/1806

USPC ..... 299/36.1, 100, 111, 113; 175/427, 430

See application file for complete search history.

(56) References Cited

U.S. PATENT DOCUMENTS

| | | | | |
|---|---|---|---|---|
| 4,582,364 | A * | 4/1986 | deMey, III | 299/107 |
| 4,725,098 | A * | 2/1988 | Beach | 299/105 |
| 4,981,328 | A * | 1/1991 | Stiffler et al. | 299/111 |
| 5,131,725 | A * | 7/1992 | Rowlett et al. | 299/111 |
| 6,051,079 | A * | 4/2000 | Andersson et al. | 148/318 |
| 6,375,272 | B1 * | 4/2002 | Ojanen | 299/111 |
| 6,394,199 | B1 * | 5/2002 | Skyles et al. | 175/336 |
| 6,428,111 | B1 | 8/2002 | Kammerer | |
| 6,508,318 | B1 * | 1/2003 | Linden et al. | 175/414 |
| 7,353,893 | B1 * | 4/2008 | Hall et al. | 175/425 |
| 7,611,210 | B2 | 11/2009 | Majagi et al. | |
| 2004/0065484 | A1 | 4/2004 | McAlvain | |
| 2009/0256413 | A1 * | 10/2009 | Majagi et al. | 299/100 |

FOREIGN PATENT DOCUMENTS

| | | | |
|---|---|---|---|
| GB | 2068040 A | * | 8/1981 |
| WO | WO 2009/126521 | | 10/2009 |

* cited by examiner

*Primary Examiner* — David Bagnell

*Assistant Examiner* — Michael Goodwin

(74) *Attorney, Agent, or Firm* — Knobbe Martens Olson & Bear LLP

(57) ABSTRACT

A tool insert is provided for increasing the operating life of a tool bit made of both the tool insert and an associated tool body. The tool insert provides at least partial protection from wear during use of the tool bit and includes a tip free of hard edges or creases that increases the operating life of the tip. The tip may include a portion that has a diameter at least equal to or larger than the diameter of the connection end of the tool body. This increases the shielding ability of the tool insert during use and extends the operating life of the tool bit. The tool insert may comprising a cylindrical stem for engagement with the tool body, the cylindrical stem having a free base end opposite a body end; and a tip connected for engaging a worked surface, the tip comprising an outer surface without hard edges.

9 Claims, 6 Drawing Sheets

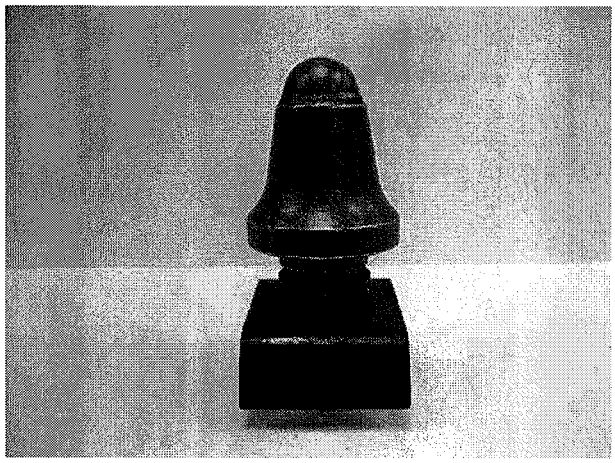
Figure 9 (New tool)
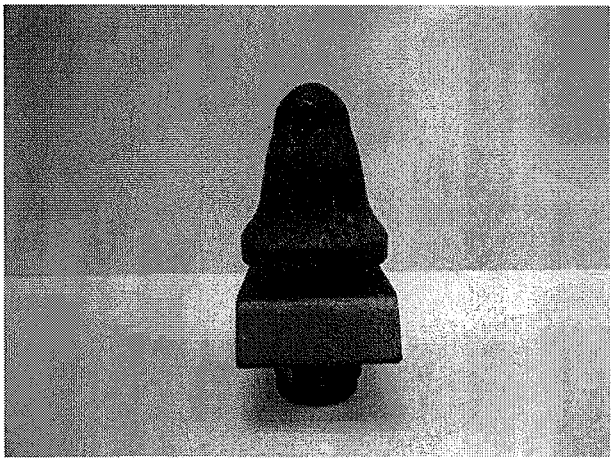
Figure 10 (Tool after 8 working hours)
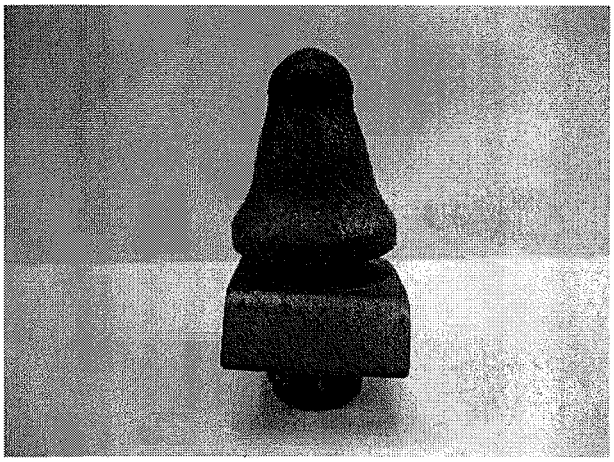
Figure 11 (Tool after 30 working hours)

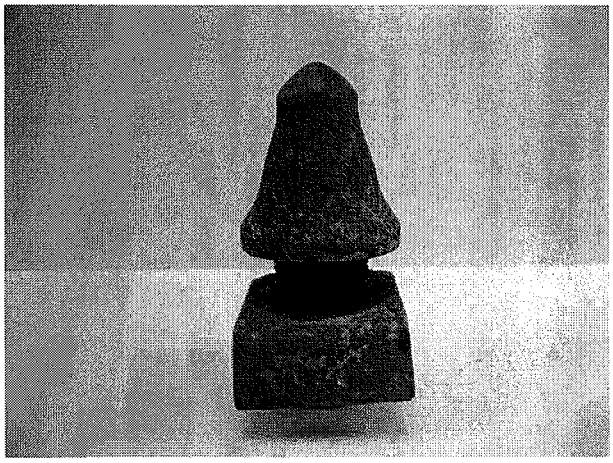
Figure 12 (Tool after 60 working hours)
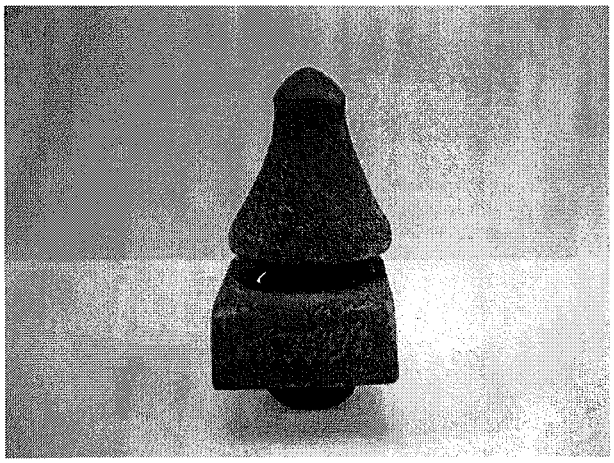
Figure 13 (Tool after 90 working hours)
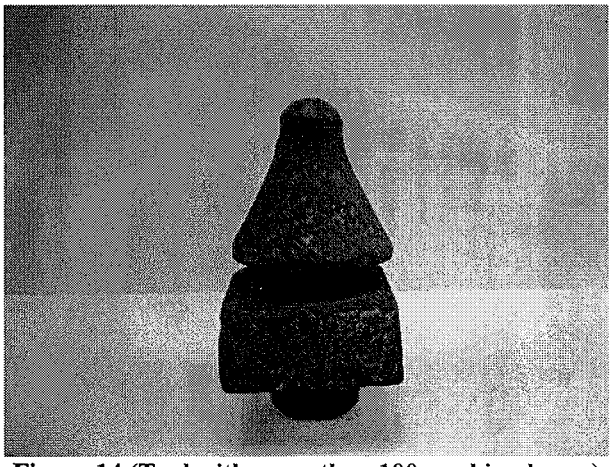
Figure 14 (Tool with more than 100 working hours)

TOOL INSERT

CROSS-REFERENCE TO RELATED APPLICATIONS

This application claims priority to Great Britain Patent Application Number GB 1112967.3, entitled TOOL INSERT, filed on Jul. 28, 2011, the entire contents of which is hereby incorporated herein by reference.

FIELD OF THE INVENTION

The invention relates to surface modifying tools for use with a surface working machine and more specifically to tool inserts for use with a rotating tool of a surface working machine.

BACKGROUND

A surface working machine, such as a grader or plough, employs a large generally horizontal blade to work the surface as needed. Different types of horizontal blades may be employed by the surface working machine to modify the surface as needed. The blade may be any type of surface working blade including a cutting edge, a serrated edge, etc. Certain circumstances require the use of a tool carrier blade wherein a plurality of tool bits, typically rotating tool bits, are connected to the blade. The tool bits engage the surface and modify the surface by cutting, gouging, shaping, etc., based on the selected tool bit.

Generally, the tool bit is comprised of a tool insert which engages the surface to modify the surface and a tool body that retains the tool insert. Generally, the tool insert is used to cut material, for example a road surface, while protecting the tool body. Generally, the tool insert is made from a stronger material such as tungsten or a tungsten alloy and helps to protect the tool body from wear during use. Nevertheless, as tool insert is worn, the tool body gradually wears as well and eventually the tool bit comprising both the tool insert and the tool body is replaced when worn out.

A large number of rotating tool bits are provided in the market for a specific purpose with different designs of tool insert as the cutting or shaping point.

There is a need to provide a tool insert that has a reduced wear rate thereby extending the life of the insert, while also protecting the tool body and extending the life of the tool body.

SUMMARY

A tool insert is provided for increasing the operating life of a tool bit comprising both the tool insert and an associated tool body. The tool insert when connected to the tool body, provides at least partial protection from wear during use of the tool bit. The tool insert includes a tip free of hard edges or creases that increases the operating life of the tip. In addition, the tip may optionally include a portion, either the tip itself or a tapered body adjacent the tip that has a diameter at least equal to or larger than the diameter of the connection end of the tool body. This increases the shielding ability of the tool insert during use and further extends the operating life of the tool bit by shielding the tool body.

In one embodiment, there is provided a tool insert for insertion into a tool body of a tool bit for a surface working machine, the tool insert comprising:

a cylindrical stem for engagement with the tool body, the cylindrical stem having a free base end opposite a body end; and a tip connected for engaging a surface to be worked, the tip comprising an outer surface free of hard edges.

In a further embodiment of a tool insert such as that described above, the tip has a convex dome shape of radius R.

In a further embodiment of a tool insert such as that described above, the cylindrical stem comprises a first bevel around the circumference of the stem at the base end and a second bevel around the circumference of the stem at the body end, the first and second bevels for engaging the tool body and distributing load substantially evenly around the tool body.

In a further embodiment of a tool insert such as that described above, the tool insert further comprises a tapered body in connection with the cylindrical stem at the body end thereof, the tapered body having an angle of taper $\alpha$.

In a further embodiment of a tool insert such as that described above, the tapered body has a minimum base diameter sufficient to cover a top end of the tool body.

In a further embodiment of a tool insert such as that described above, the tapered body has a minimum base diameter equal to or greater than an outside diameter of the tool body thereby protecting the tool body when inserted into the tool body.

In a further embodiment of a tool insert such as that described above, the tapered body has an angle of taper $\alpha$ of approximately 12°.

In a further embodiment of a tool insert such as that described above, the first and/or second bevel has an angle of approximately 45°.

In a further embodiment of a tool insert such as that described above, the radius R is approximately 0.350 inches.

In a further embodiment of a tool insert such as that described above, the tip has an elliptical dome shape having a diameter greater than or equal the outside diameter of the tool body In another embodiment, there is provided a tool bit for a surface working machine, the tool bit comprising:

a tool insert such as a tool insert as described above; and a tool body for connection to a tool carrier blade of the surface working machine;

the tool body comprising a neck at one end for connection to the tool carrier blade and an insert cavity at an opposite end for accommodating the tool insert.

BRIEF DESCRIPTION OF THE DRAWINGS

FIG. 9 is a photograph of a tool bit including an embodiment of a tool insert mounted in a tool body before testing, i.e. 0 hours;

FIG. 10 is a photograph of the tool bit of FIG. 9 following 8 working hours of testing;

FIG. 11 is a photograph of the tool bit of FIG. 9 following 30 working hours of testing;

FIG. 12 is a photograph of the tool bit of FIG. 9 following 60 working hours of testing;

FIG. 13 is a photograph of the tool bit of FIG. 9 following 90 working hours of testing; and FIG. 14 is a photograph of the tool bit of FIG. 9 following more than 100 working hours of testing.

DETAILED DESCRIPTION

Figure 1:
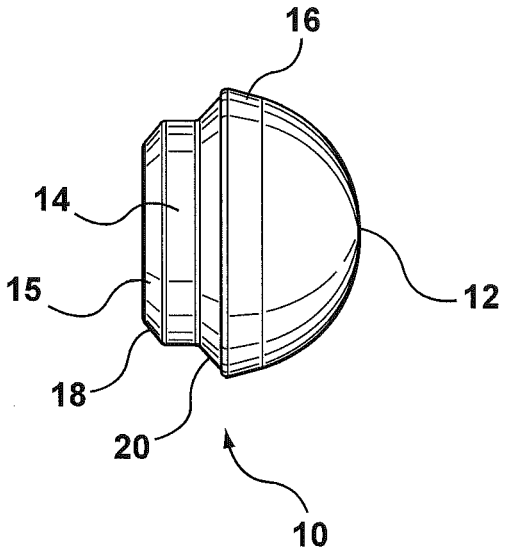
FIG. 1 is a schematic diagram illustrative of an embodiment of a tool insert.

One embodiment of a tool insert for connection to a tool body to form a tool bit for use, for example, with a surface working machine is shown in FIG. 1 at 10. The tool insert 10 shown in FIG. 1 is a rotatable tool insert and comprises a cylindrical stem 14 for insertion into a tool body (shown in FIG. 2).

The base of the stem 14 terminates in a free end referred to herein as a base end 15. In the illustrated embodiment, the cylindrical perimeter of the base end 15 includes an optional bevel 18 along the circumference of the base end 15. The bevel 18 helps to distribute the load imparted on the tool insert when in use and particularly the sheering forces imparted on the tool insert 10. The end of the stem 14 opposite the base end 15 is adjacent a tapered body 16. Again, as a rotatable tool insert is shown, the tapered body 16 is shown as having a circular perimeter. The stem 14 may further include a second optional bevel 20 where the stem 14 joins with the tapered body 16. The second bevel 20 also helps to distribute the load imparted on the tool insert when in use and particularly the sheering forces imparted on the tool insert 10.

The tapered body 16 includes an inward taper, the tapered body 16 narrowing in diameter as it extends away from the stem 14. The tapered body 16 includes a taper angle $\alpha$ of from approximately 0° wherein there is no taper to below 90° wherein there is a significant taper. In one embodiment the taper angle $\alpha$ is between 10° and 30°. In further embodiments the taper angle $\alpha$ is 12° or 24°. The taper of the tapered body 16 may be uniform or may include an increasing or decreasing taper angle.

Adjacent the tapered body 16 is the tip 12 of the tool insert. The tip 12 is the primary contact with the surface being worked and has a shape suitable for cutting, gouging, shaping, etc, the surface as desired. Once the tip 12 has been worn out the tool bit may be replaced. In order to increase the functional life of the tool insert 10 it has been determined that the tip may be shaped so that it is free of hard edges or corners which have a tendency to increase the wear rate of the tip resulting in a shorter life span and higher operating cost of the machine. In addition to being free of hard edges or corner, the tip 12 may additionally have a convex shape of radius R.

I one embodiment of the tool insert 10, the tip has a dome convex shape of radius R, wherein R is 0.350 inches such as that illustrated in FIG. 1.

It will be appreciated that the insert tool 10 illustrated in FIG. 1 has a circular perimeter shape so that when rotating the tool is substantially symmetrical and allows for substantially symmetric rotation. However, the tool insert 10 may have a perimeter which includes shapes other than circular and is free of hard edges or corners.

Figure 2:
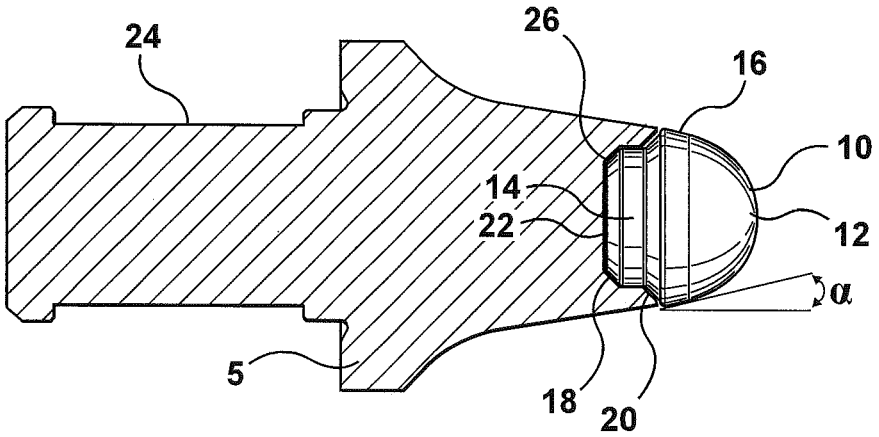
FIG. 2 is a schematic diagram of the tool insert of FIG. 1 mounted in an illustrative tool body.

FIG. 2 shows an illustrative schematic of an embodiment of a tool bit comprising a tool insert 10 such as that described with reference to FIG. 1 installed in a tool body 5. The tool body 5 may be a standard tool body including those known in the art and includes a neck 24 for connection to the tool carrier blade using various methods, for example a tool clip.

The tool body 5 also includes a shaped cavity 26 at the exterior end of the tool body 5 for receiving and accommodating the tool insert 10. The cavity 26 ideally has an interior shape that matches the exterior shape of the stem 14 of the tool insert 10 so that the tool insert 10 can be mated with the cavity 26 in a male-female connector fashion.

As shown in FIG. 2, the tool insert 10 includes the tapered body 16, the exterior diameter of which may be equal to or greater than the exterior diameter of the tool body 5 at the connection end of the of the tool body 5 so that the insert tool 10 at least partly shields the tool body 5 from damage during operation. The more the tool insert 10 shields the tool body 5 from wear during use, the more the lifespan of the tool body 5 is prolonged. The increase in exterior diameter between the stem 14 and the tapered body 16 may be accomplished with a flange like extension between the stem 14 and the tapered body 16, or through the bevel 20 or a combination of both elements as illustrated.

The tool insert 10 may be fastened to the tool body 5 using known methods including, for example, a brazing bond 22.

Figure 3:
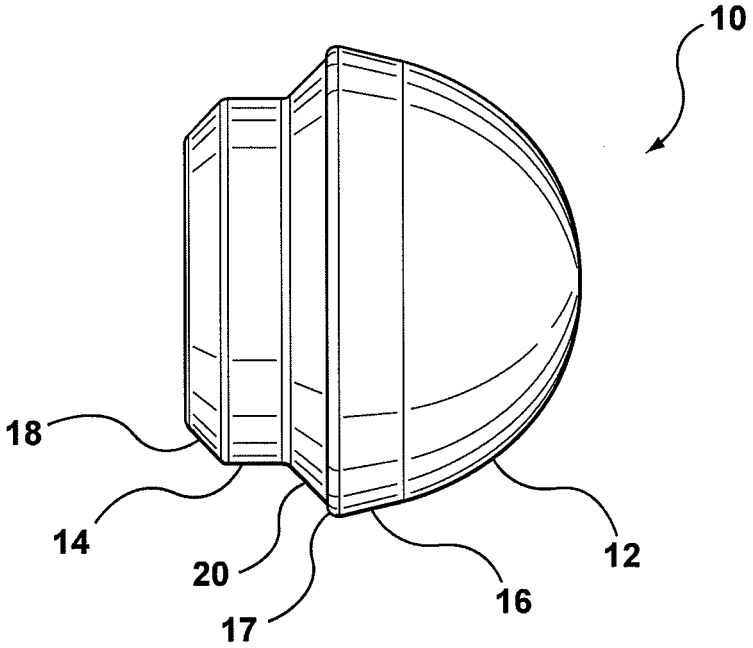
FIG. 3 is a side view of the tool insert of FIG. 1.

FIG. 3 shows a side view of the tool insert 10 as described with reference to FIG. 1. As shown in the side view, in addition to the bevel 20, the tapered body 16 is spaced outwards from the stem 14 by also using a small step or flange 17 in order to have a diameter at least equal to or greater than the outside diameter of the tool body 5 at the connection end of the tool body 5 so that the tool insert 10 at least partly shields the tool body 5 from damage during operation.

Figure 4:
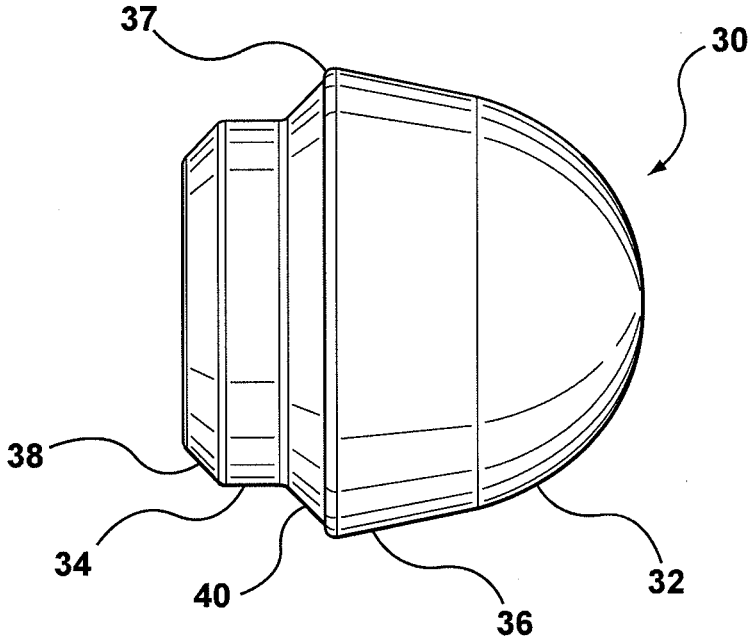
FIG. 4 is a side view illustrative of a further embodiment of a tool insert.

FIG. 4 shows a side view of another embodiment of a tool insert 30 for insert into a tool body such as that shown for example in FIG. 2. Similar to the tool insert 10 of FIG. 1, the tool insert 30 of FIG. 4 includes a stem 34 adjacent a tapered body 36 adjacent a tip 32. The stem 34 includes a bevel 38 at the free end and a bevel 40 at the end adjacent the tapered body 36. The convex dome radius R of the tip 32 is slightly smaller than the dome radius of the tip 12 illustrated in FIG. 1 and is therefore less than 0.350 inches. To obtain the smaller radius R, the tapered body 36 may either be lengthened as illustrated in FIG. 4 or the taper angle $\alpha$ may be increased. By using a tip 32 with a different convex dome radius R, a tool with different surface working characteristics is provided.

As shown in the side view of FIG. 4, in addition to the bevel 40, the tapered body 46 is spaced outwards from the stem 34 by also using a small step or flange 37 in order to have a diameter at least equal to or greater than the outside diameter of the tool body at the connection end of the tool body so that the tool insert 30 at least partly shields the tool body from damage during operation.

Figure 5:
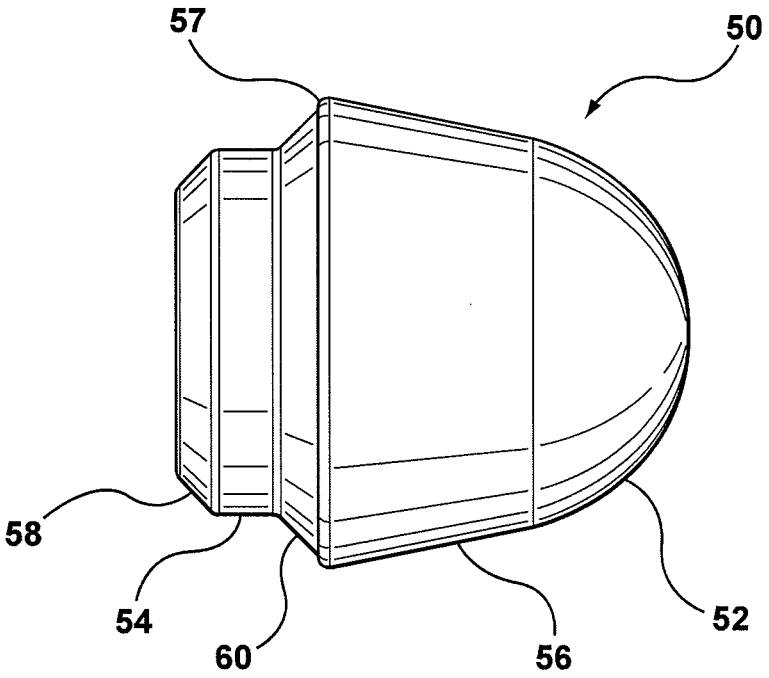
FIG. 5 is a side view illustrative of a further embodiment of a tool insert.

FIG. 5 shows a side view of another embodiment of a tool insert 50 for insert into a tool body such as that shown for example in FIG. 2. Similar to the tool insert 10 of FIG. 1, the tool insert 50 of FIG. 5 includes a stem 54 adjacent a tapered body 56 adjacent a tip 52. The stem 54 includes a bevel 58 at the free end and a bevel 60 at the end adjacent the tapered body 56. The convex dome radius R of the tip 32 is slightly smaller than the dome radius of the tip 12 illustrated in FIG. 1 and the tip 32 illustrated in FIG. 3 and is therefore less than 0.350 inches. To obtain the smaller radius R, the tapered body 36 may either be lengthened as illustrated in FIG. 5 or the taper angle $\alpha$ may be increased. By using a tip 52 with a different convex dome radius R, a tool with different surface working characteristics is provided.

As shown in the side view of FIG. 5, in addition to the bevel 60, the tapered body 56 is spaced outwards from the stem 54 by also using a small step or flange 57 in order to have a diameter at least equal to or greater than the outside diameter of the tool body at the connection end of the tool body so that the tool insert 50 at least partly shields the tool body from damage during operation.

Figure 6:
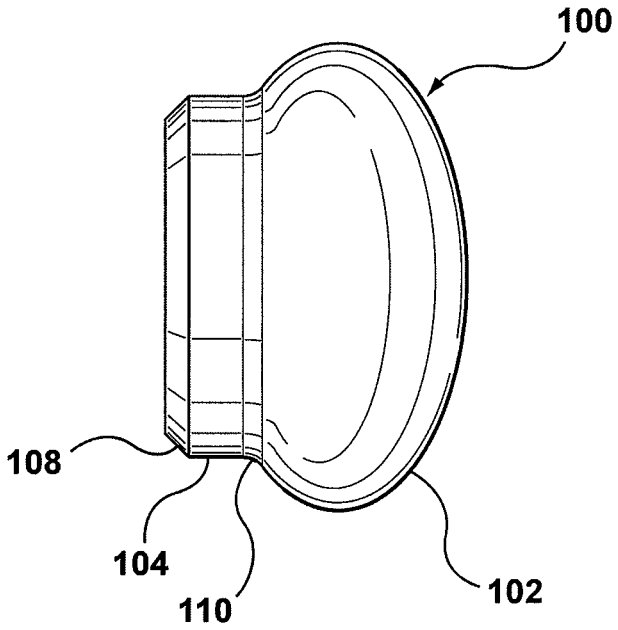
FIG. 6 is a side view illustrative of a further embodiment of a tool insert.

FIG. 6 shows a side view of another embodiment of a tool insert 100 for insert into a tool body such as that shown for example in FIG. 2. The tool insert 100 differs in constructions from the tool inserts outlined above with reference to FIG. 1, 4 or 5, in that the tapered body is omitted in favour of an elliptical dome tip 102. The tool insert 100 includes a stem 104 with a first bevel 108 at the free end thereof as well as a bevel 110 at the end adjacent the tip 102 and as such the stem is similar in layout to those previously described. The tool insert 100 however does not use a step or flange in order to increase the diameter of the tip to be at least the same size or greater than the outside diameter of the connection end of the tool body, but rather uses an elliptical dome shape having a radius of the ellipse along the long axis larger than the radius of the tool body to be able to protect the tool body during use.

Figure 7:
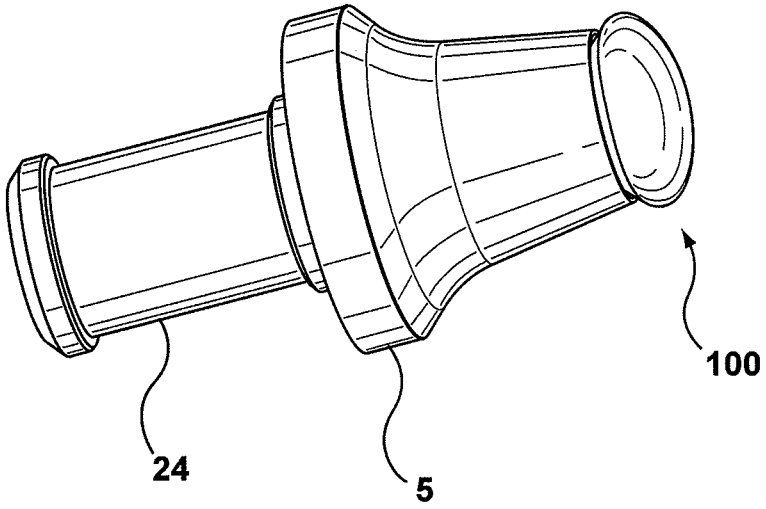
FIG. 7 is a perspective view illustrative of a the tool insert of FIG. 7 mounted in a tool body.

FIG. 7 shows a perspective view of an embodiment of the tool insert 100 as described with reference to FIG. 6 fastened to a tool body 5 such as that described for example with reference to FIG. 2. The tool insert 100 is inserted into a tool cavity in the in the tool body 5 and fastened using typical means such as a brazing bond. The tool body 5 with the tool insert 100 may then be connected to a tool carrier blade using any suitable means such as for example a tool clip attached to the neck 24.

Figure 8:
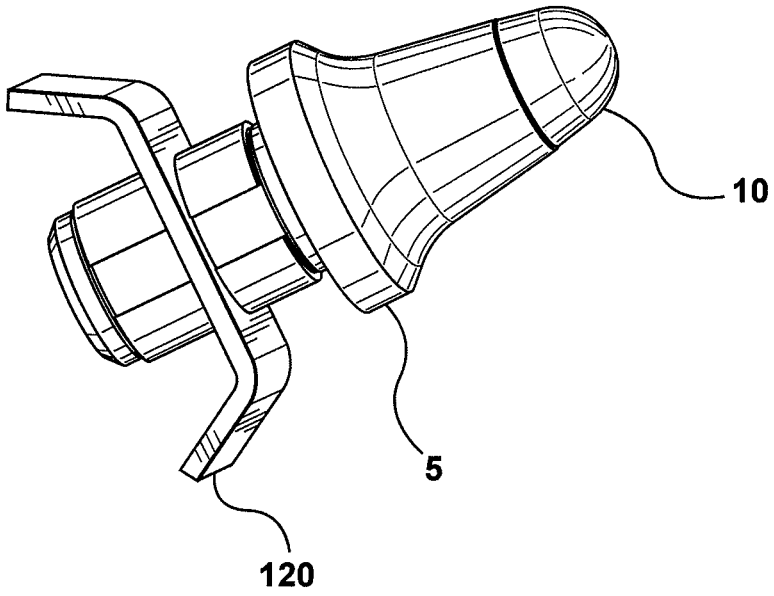
FIG. 8 is a perspective view illustrative of the tool insert of FIG. 5 mounted in a tool body, the tool body mounted in a tool retention clip.

FIG. 8 shows a perspective view of an embodiment of a tool insert, such as tool insert 10 as described with reference to FIGS. 1, 2 and 3 connected to a tool body such as tool body 5 described with reference to FIG. 2 mounted to a typical tool clip 120 for connection with a tool carrier blade. It will be appreciated that any fastening apparatus or means may be used that allows for connection, and optionally rotational connection, of the tool bit including the tool body and tool insert to a tool carrier blade for use in working a surface.

The tool inserts described herein may be manufactured from tungsten as is the traditional practice. It will be appreciated that various tungsten alloys or other metals or metal alloys may be used in an effort to increase the durability and/or effectiveness of the tool insert which are within scope of the tool inserts described herein.

It will be appreciated that the tool inserts outlined herein are interchangeable with standard tools available and may be used with typical tool bodies for use with tool carrier blades. The tool body may have a cavity adapted to accommodate the tool insert. A precision mating of the tool insert with the tool cavity increases the stress and forces that the tool insert can withstand as well as the sheering forces.

Test Data

A tool insert similar to that described with reference to FIGS. 1, 2 and 3 was tested to observe the operational life as well as the level of protection offered to the tool body during use. A superior wear pattern was achieved relative existing tool bits comprising existing tool inserts fitted to a tool body. The superior wear pattern leads to an extended tool life. Proportionally uniform wear of the tungsten tool insert contributes to reduced wear of the steel tool body. In addition, configuration of the joint between the tool insert and the tool body contributed to increased strength of the tool. In addition, a resistance to chipping and breaking off of the tool insert was observed.

FIGS. 9 to 14 show a tool insert similar to that described with reference to FIG. 1 fastened to a tool body such as that described with reference to FIG. 2 mounted in a typical tool retaining clip for fastening to a tool carrier blade. The tool bit of FIG. 9 is a photo of a new tool with 0 working hours of time. FIG. 10 shows the tool bit following 8 working hours and shows that the tool insert is intact and usable while the tool body and retaining clip have been substantially protected during testing and are still have operational utility. FIG. 11 shows the tool bit following 30 working hours and shows that the tool insert is intact and usable while the tool body and retaining clip have been substantially protected during testing and are still have operational utility. FIG. 12 shows the tool bit following 60 working hours and shows that the tool insert is intact and usable while the tool body and retaining clip have been substantially protected during testing and are still have operational utility. FIG. 13 shows the tool bit following 90 working hours and shows increasing wear on the tool insert, which remains intact and usable while the tool body and retaining clip show increased levels of wear but remain intact with a usable life remaining. Utility of the tool insert, tool body and retaining clip has been maintained. FIG. 14 shows the tool bit following more than 100 working hours. Again, the tool insert shows increasing levels of wear as does the tool body and tool retaining clip. However, usable operating life remains in the tool insert as well as the tool retaining clip.

Similar testing of existing tool clips show a usable life of between about 30 and 40 hours.

It will be appreciated that various modifications and additions may be made to the tool inserts outlined herein without departing from scope of the invention and these modifications and/or additions are within the contemplated scope of the invention.

We claim:

1. A tool insert for insertion into a tool body of a tool bit for a surface working machine, the tool insert comprising:

a cylindrical stem for engagement with the tool body, the cylindrical stem having a free base end opposite a body end, wherein the cylindrical stem comprises a first bevel around the circumference of the stem at the base end and a second bevel around the circumference of the stem at the body end, the first and second bevels for engaging the tool body and distributing load substantially evenly around the tool body;

a tapered body connected directly or indirectly to the cylindrical stem at the body end thereof, the tapered body having an angle of taper ($\alpha$); and a tip having a convex dome shape of radius (R) and connected for engaging a surface to be worked, the tip comprising an outer surface free of hard edges and adjacent the tapered body opposite the cylindrical stem.

2. The tool insert of claim 1, wherein the tapered body has a minimum base diameter equal to or greater than a maximum outside diameter of the second bevel around the circumference of the stem at the body end.

3. The tool insert of claim 1, wherein the tapered body has an angle of taper ($\alpha$) of approximately 12°.

4. The tool insert of claim 1, wherein the first and/or second bevel has an angle of approximately 45°.

5. The tool insert of claim 1, wherein the radius (R) is approximately 0.350 inches.

6. The tool insert of claim 1, wherein the tip has an elliptical dome shape having a diameter greater than or equal to a maximum diameter of the second bevel around the circumference of the stem at the body end.

7. A tool bit for a surface working machine, the tool bit comprising:

a tool insert as defined in claim 1; and a tool body for connection to a tool carrier blade of the surface working machine;

the tool body comprising a neck at one end for connection to the tool carrier blade and an insert cavity at an opposite end for accommodating the tool insert.

8. The tool bit of claim 7, wherein the tool body has a top end suitable for receiving the tool insert, the top end having a generally circular exterior edge defining an outside diameter of the top end of the tool body, and wherein the tapered body has a minimum base diameter equal to or greater than the outside diameter of the top end of the tool body.

9. The tool bit of claim 7, wherein the tool body has a top end defining an outside width of the top end of the tool body, and wherein the tapered body has a minimum base diameter equal to or greater than the outside width of the top end of the tool body.

* * * * *